US005623737A

United States Patent [19]

Moyer, Jr. et al.

[11] Patent Number: 5,623,737

[45] Date of Patent: Apr. 29, 1997

[54] COMBINATION TOOL FOR WALLBOARD

[76] Inventors: William L. Moyer, Jr.; Gregory A. Moyer, both of R.D. 3, Box 580, Bedford, Pa. 15522

[21] Appl. No.: 336,243

[22] Filed: Nov. 7, 1994

Related U.S. Application Data

[63] Continuation-in-part of Ser. No. 23,557, May 26, 1994, Pat. No. Des. 360,817.

[51] Int. Cl.[6] ..... B26B 11/00

[52] U.S. Cl. ..... 7/158; 7/118; 30/125; 30/157

[58] Field of Search ..... 7/118, 158; 30/125, 30/157, 162

[56] References Cited

U.S. PATENT DOCUMENTS

| | | | |
|---|---|---|---|
| D. 305,096 | 12/1989 | Tench et al. . | |
| 2,980,996 | 4/1961 | Beran | 30/157 |
| 3,528,153 | 9/1970 | Walter . | |
| 4,028,758 | 6/1977 | O'Cconnor . | |
| 4,587,964 | 5/1986 | Walker et al. . | |
| 4,635,309 | 1/1987 | Larsen . | |
| 4,761,882 | 8/1988 | Silverstein | 30/125 X |
| 4,890,387 | 1/1990 | Canino . | |
| 4,910,821 | 3/1990 | Kieferle . | |
| 4,921,493 | 5/1990 | Webb, Jr. et al. . | |
| 4,974,320 | 12/1990 | Pelletier . | |

*Primary Examiner*—James G. Smith
*Attorney, Agent, or Firm*—Richard C. Litman

[57] ABSTRACT

A combination hand tool for use in the construction and finishing of interior wallboard panels in the construction trade, provides a utility knife for cutting and scoring of the board to the desired dimensions, a rasp or file surface for smoothing the cut edge of the wallboard, and a smoothly rounded handle end for use in tamping or burnishing the cut paper edge of the wallboard. The combination tool eliminates need for additional tools for the job, and enables the user to provide more smoothly finished edges to substantially reduce the time and materials otherwise required in applying tape and joint compound to relatively rough or unfinished edges. The tool is preferably formed of relatively durable materials, i.e., aluminum or stainless steel for corrosion resistance and long life, and is configured to accept standard utility knife blades. The rasp or file portion may be provided on either side of the tool for use by left or right handed persons, and is preferably oriented to require action away from the blade for safety. The offset handle parting line provides a smooth and unbroken end for optimum use in smoothing or burnishing paper edges.

8 Claims, 3 Drawing Sheets

COMBINATION TOOL FOR WALLBOARD

CROSS REFERENCE TO RELATED PATENT APPLICATION

This application is a continuation in part of U.S. Design patent application Ser. No. 29/023,557, filed on May 26, 1994, now U.S. Pat. No. 360,817 issued on Aug. 1, 1995.

FIELD OF THE INVENTION

The present invention relates generally to hand tools, and more specifically to a hand tool for use in wallboard construction, which tool provides multiple uses and operations in the cutting and smoothing of such wallboard without need for multiple tools.

BACKGROUND OF THE INVENTION

Modern residential and commercial building construction makes use of a great deal of gypsum wallboard, or drywall, for interior wall and ceiling panel construction. The material requires much less labor and skill than earlier interior wall and ceiling finishing techniques (e.g., plaster), and consequently is considerably more economical when labor costs are considered.

Nevertheless, a fair amount of highly skilled labor is involved in cutting, shaping, and smoothing wallboard, even before joint tape and wallboard compound is applied and finished. Conventionally, a utility knife or the like is used to cut the wallboard panels as desired to fit rough door, window, and other openings and shapes, as well as to conform to other areas to be paneled. Each time a board is cut, the paper surfaces on each side produce a slightly protruding edge which must be smoothed, resulting in the need for another tool, and if the relatively rough edge of the gypsum core is to form an exterior corner it must be smoothed also, which need requires yet another tool. The alternative is considerable filling with wallboard compound to smooth the edges and surfaces, which procedure is both labor and material intensive.

The need arises for a single tool which may be used to cut the board or score it for breaking to the required dimensions, and also provides for the smoothing of the relatively rough edge of the gypsum core after such cutting or breaking operation and for the smoothing or burnishing of the edge of the paper after such cutting or breaking. The tool should be durable and safe to use, and further provide for the replacement of cutting blades as required.

DESCRIPTION OF THE PRIOR ART

U.S. Pat. No. 3,528,153 issued to Ernest W. Walter on Sep. 15, 1970 discloses a Rasp Blade Construction for use in abrading the surface of tires in preparation for recapping. The rasp is formed of multiple stamped metal portions secured to a curved holder. The result would be unsuitable for use in the environment of the present invention, due to the curved shape of the rasp configuration for automated rotary operation, and the lack of a handle for manual use, additional tools in combination therewith, and the lack of parallel individual teeth for smooth cutting or abrading of a surface.

U.S. Pat. No. 4,028,758 issued to John J. O'Connor on Jun. 14, 1977 discloses a Combination Utility Knife And Staple Remover comprising a knife portion having a similar configuration to a conventional utility knife with a retractable blade. An extension having a forked staple remover is also provided. Due to its configuration, the tool is capable of providing only one of the three functions of the tool of the present invention, and due to the retractable blade is somewhat more complex and likely to be less durable than the fixed knife blade of the present tool.

U.S. Pat. No. 4,587,964 issued to Charles B. Walker et al. on May 13, 1986 discloses a Rasp Tool having a removable, curved cutting rasp extending from a handle portion. The tool is configured for use in surgery, specifically in the shaping of the femur for a femoral prosthesis. The configuration of the Walker device does not provide for use in smoothing a linear surface or edge, as required in wallboard work, nor is the rasp formed integrally with the handle, as in the present tool invention. Multiple functions are not disclosed in the Walker tool.

U.S. Pat. No. 4,635,309 issued to Peter L. Larsen on Jan. 13, 1987 discloses a Multiple Use Hand Tool comprising a utility knife with retractable blade, and a marking crayon extendable from the opposite end of the handle. The tool does not provide any scraping, filing or rasping function, nor is a smoothly contoured surface provided for smoothing and burnishing edges, as provided for by the present invention.

U.S. Pat. No. 4,890,387 issued to Serafino S. Canino on Jan. 2, 1990 discloses a Drywall Utility Knife having a retractable blade at one end of a handle and an arcuately foldable saw blade extendable from the opposite end of the handle. The rasp portion is located on the side of the handle which is essentially coplanar with the cutting edge of the extended blade, thus requiring the blade to be retracted or risk cutting or damaging the surface or edge as it is being smoothed by the rasp. The present tool provides a wider, unbroken rasp surface parallel to the plane of the blade to preclude scoring the surface with the blade while using the rasp. No tamping or burnishing means is provided by the Canino tool, due to the opposite bifurcated ends of the tool providing for the retraction of the saw and knife blades.

U.S. Pat. No. 4,910,821 issued to Ralph M. Kieferle on Mar. 27, 1990 discloses a Screen Installers Tool essentially comprising a utility knife with retractable blade, and a screen seating roller at the opposite end from the blade. No filing or rasping means or tamping or burnishing means is disclosed, as provided by the present tool invention.

U.S. Pat. No. 4,921,493 issued to John D. Webb on May 1, 1990 discloses a Rasp Tool having separable rasp and handle portions. The handle portion includes a rounded head, but due to the diameter of the head portion, no continuous surface of the rasp may be worked over a flat surface or linear edge of a panel, as is required in work with wallboard. No knife blade is provided for the cutting of material.

U.S. Pat. No. 4,974,320 issued to Peter D. Pelletier on Dec. 4, 1990 discloses a Rotatable Utility Knife having a retractable blade at one end and a rotating, toothed cutting wheel at the opposite end from the blade. Both the blade and the cutting wheel serve the same function, i.e., to cut or score one side of the paper surface of a wallboard sheet so the board may be broken along the score line as desired. No rasp or other means for smoothing the cut edge, nor means for smoothing or burnishing the cut edge or paper therealong, is disclosed.

Finally, U.S. Design Pat. No. D-305,096 issued to Wallace Tench et al. on Dec. 19, 1989 discloses a design for a Retractable Blade Knife having a generally rectilinear configuration. A series of transverse ridges and slots is shown in the underside of the handle, providing grip means for the tool. No rasp or file means is shown, nor is any rounded portion for tamping or burnishing of edges provided, as in the present tool.

None of the above noted patents, taken either singly or in combination, are seen to disclose the specific arrangement of concepts disclosed by the present invention.

SUMMARY OF THE INVENTION

By the present invention, an improved combination tool for use in working wallboard and the like, is disclosed.

Accordingly, one of the objects of the present invention is to provide an improved combination tool which includes cutting, rasping or filing, and burnishing or tamping means in a single tool.

Another of the objects of the present invention is to provide an improved combination tool which provides a relatively wide and unbroken surface on at least one side of the handle, with the surface being parallel to the knife blade and having a plurality of transverse rasp or file teeth formed thereacross.

Yet another of the objects of the present invention is to provide an improved combination tool which includes a smoothly rounded and unbroken end opposite the knife blade, with the unbroken end providing for the tamping or burnishing of a cut edge of wallboard paper.

Still another of the objects of the present invention is to provide an improved combination tool which is configured to accept conventional utility knife blades.

A further object of the present invention is to provide an improved combination tool which rasp teeth may be provided on either side of the handle portion for use by left or right handed persons, or alternatively may be provided on both sides of the handle portion if desired.

An additional object of the present invention is to provide an improved combination tool which rasp teeth are oriented to provide a cutting action when the tool is moved away from the direction of the blade, thereby providing greater safety for a user of the tool.

Another object of the present invention is to provide an improved combination tool which is divided into two opposite sides, which sides are assembled together to sandwich a utility knife blade centrally therebetween and which sides provide an offset parting line in order to provide for the seating of the centrally disposed blade in one side.

Yet another object of the present invention is to provide an improved combination tool which includes no moving parts, thereby providing a solid and durable tool.

Still another object of the present invention is to provide an improved combination tool which may be formed of a variety of materials, but which is preferably formed of a durable metallic material, e.g., aluminum or stainless steel for durability and corrosion resistance.

A final object of the present invention is to provide an improved combination tool for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
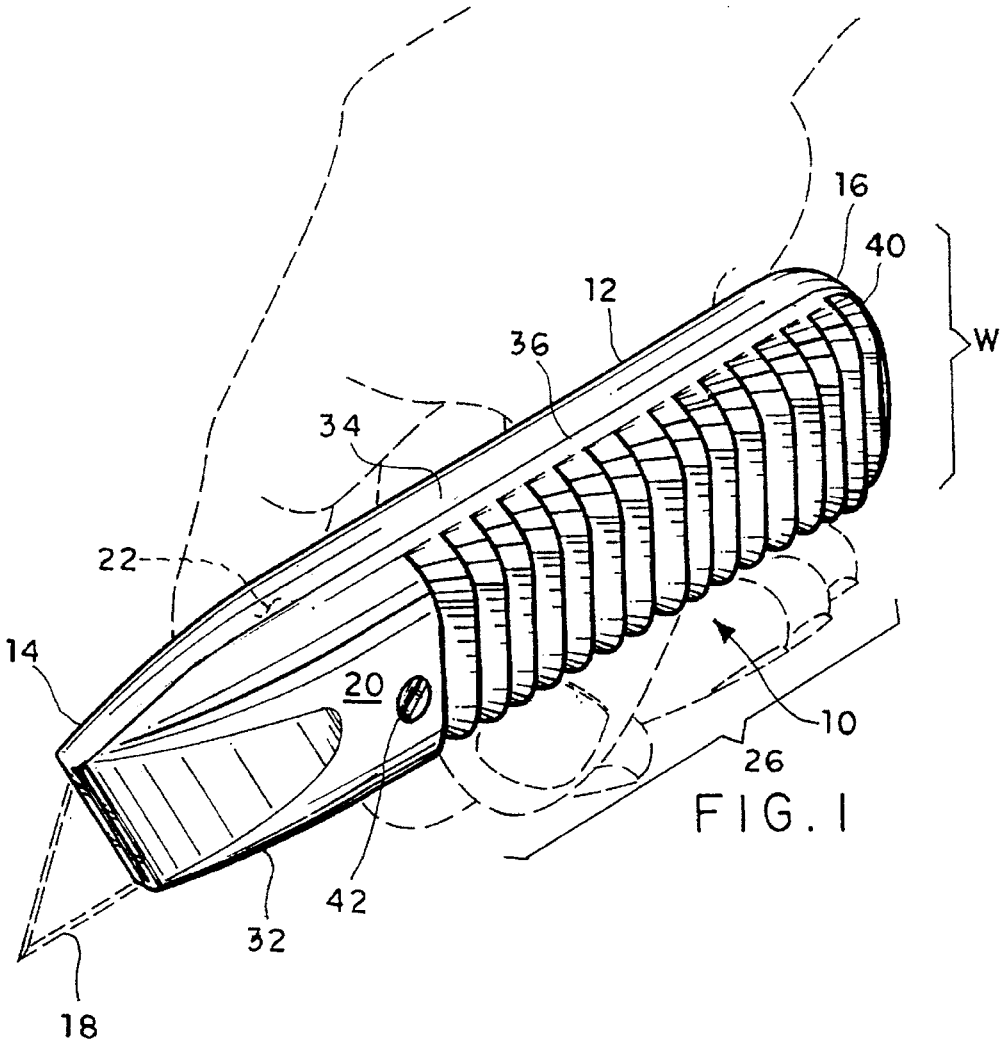
FIG. 1 is an environmental perspective front view of the present tool in a preferred configuration for use by a right-handed person- and positioned for the cutting of wallboard or other material.

Referring now particularly to FIG. 1 of the drawings, the present invention will be seen to relate to a combination hand tool 10 providing multiple functions in the fabrication and finishing of wallboard or drywall construction. The hand tool 10 generally comprises an elongated handle portion 12 having opposite first and second ends 14 and 16. The first end 14 includes a planar utility knife blade 18 extending therefrom. The handle portion 12 also has opposite first and second sides 20 and 22, with the sides 20 and 22 being flat and parallel to the plane of the knife blade 18. The width or major dimension W (FIG. 1) of the handle portion 12, defined by the sides 20 and 22, is greater than its thickness or minor dimension T (FIG. 3).

Figure 2:
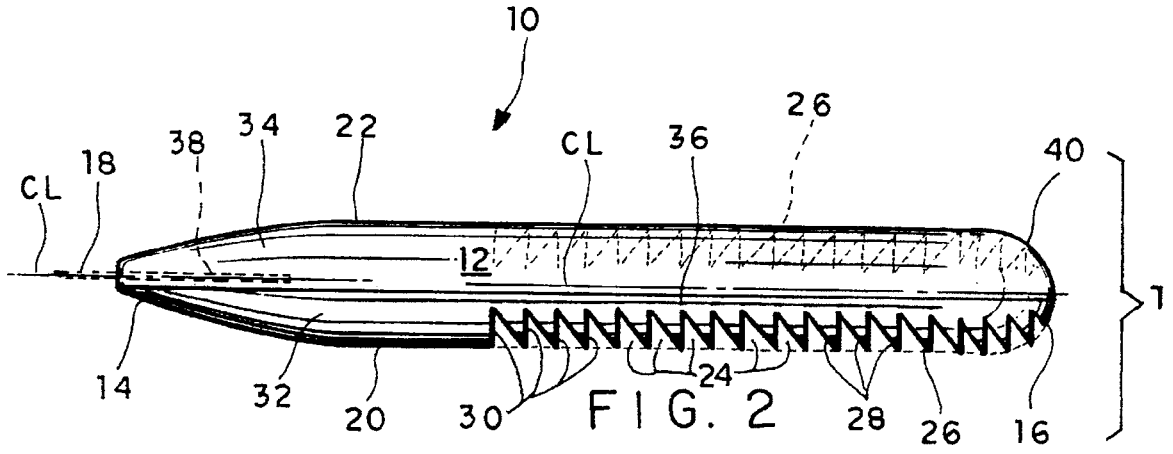
FIG. 2 is a top view, showing in addition an alternative configuration for the rasp or file side on the opposite side of the handle portion and the offset parting line for the two halves of the handle.
Figure 3:
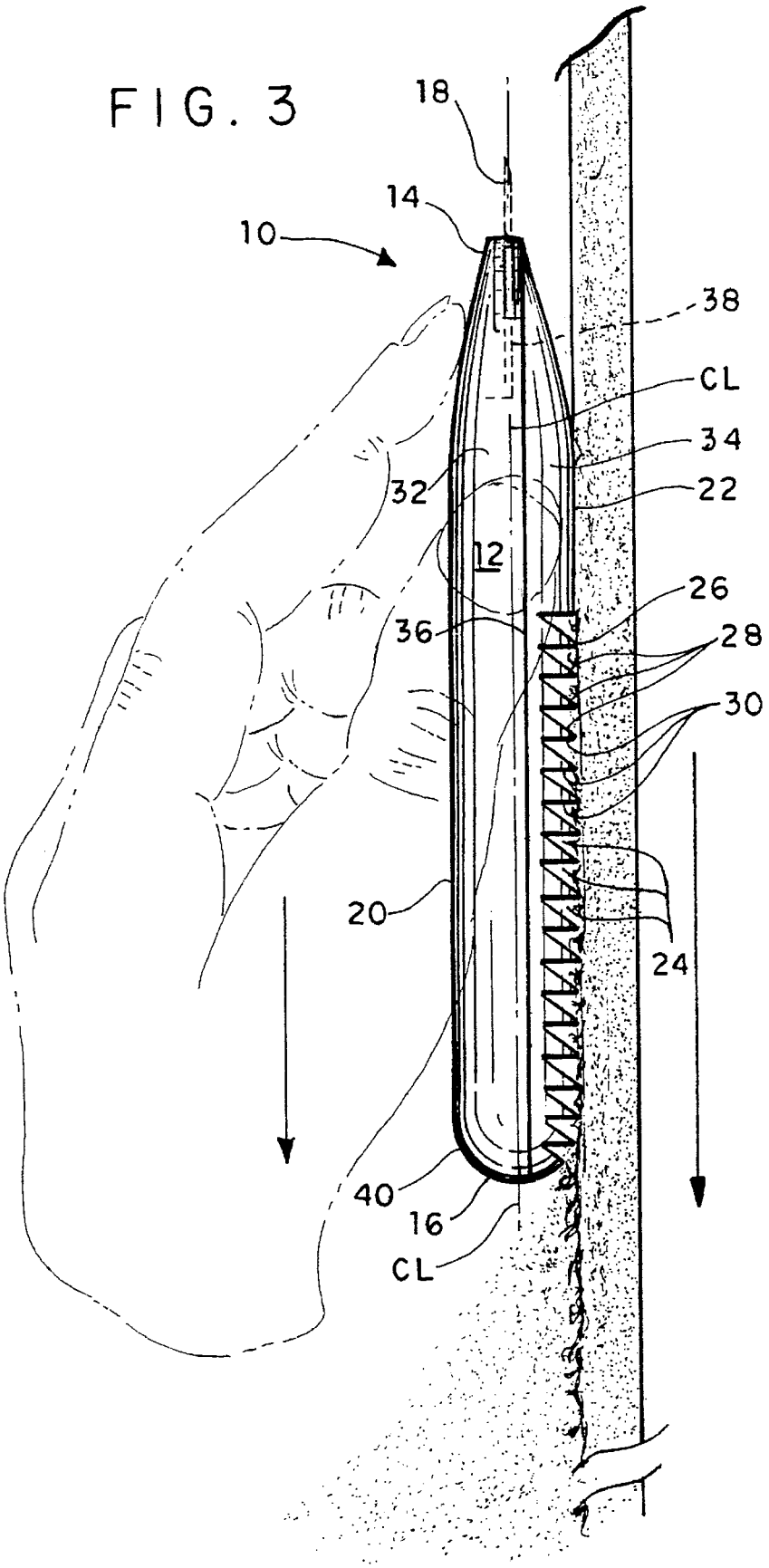
FIG. 3 is a bottom view showing the use of the rasp or file portion of the tool in a left hand configuration, smoothing a cut drywall edge.
Figure 4:
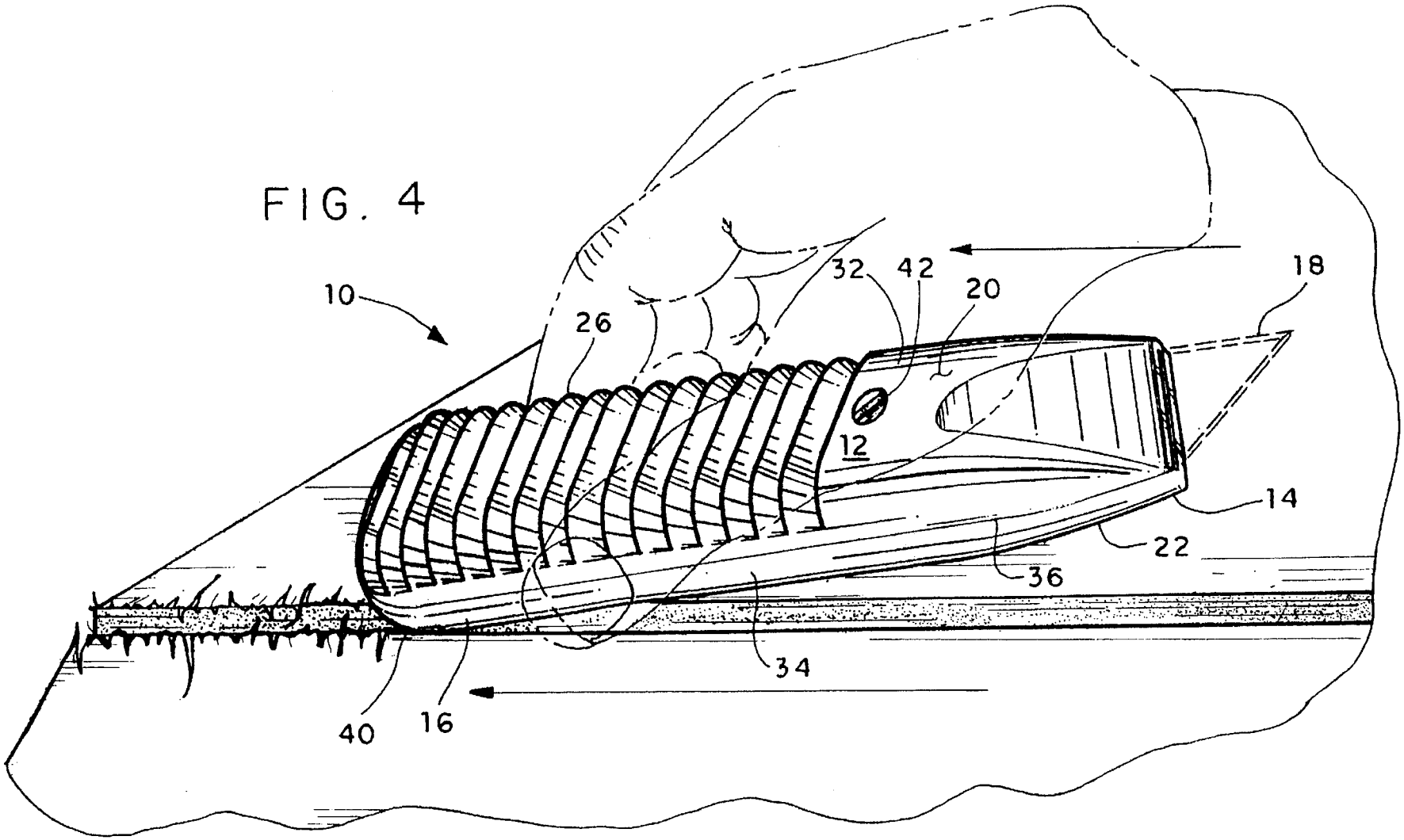
FIG. 4 is a rear perspective view showing the use of the rounded end portion of the tool in smoothing or burnishing a cut wallboard edge.

At least one of the two opposite sides 20 and 22 includes a plurality of transverse grooves or teeth 24 therein, to provide a rasp or file surface 26 for smoothing exposed edges of wallboard material, as shown in the bottom view FIG. 3. The grooves or teeth 24 preferably have a triangular, saw tooth configuration, as shown in the top view of FIG. 2, with each groove 24 having an inwardly sloping side 28 angled towards from the first or knife blade end 14 of the handle portion 12, and an opposite side 30 which is vertical to the planar handle side 20 and/or 22. The edges along which the two sides 28 and 30 meet are sharply formed to provide good cutting action. As the grooves or teeth 24 are sloped away from the knife blade 18, the rasp or file surface 26 can only provide good cutting or rasping action when the tool 10 is drawn away from the knife blade 18, as shown by the directional arrow in FIG. 3. This configuration of the grooves or teeth 24 provides for safe use of the tool 10, as if the user's hand slips, it will move away from the blade 18 rather than toward it. The tool 10 shown in FIG. 3 will be seen to have the rasp surface 26 formed in the second side 22 of the handle portion 12, which configuration is more convenient for left-handed users of the tool 10. However, the orientation of the rasp grooves or teeth 24 is still rearward, as in the tools 10 of FIGS. 1, 2, and 4, for the safety reasons discussed above.

The handle portion 12 is formed of a first section 32 and a second section 34, corresponding, respectively, to the first and second sides 20 and 22. The two sections 32 and 34 join together and are separable along a parting line 36, which defines a plane which is parallel to the plane of the planar utility knife blade 18. The plane of the knife blade 18 will be seen to be coplanar with the centerline CL of the tool 10; in other words, the blade 18 is centered in the tool 10. However, it will be noted that the parting line 36 is not coplanar with the tool centerline CL, but is offset therefrom. This offset of the parting line 36 provides several advantages. First of all, the offset parting line 36 provides a receptacle 38 (FIGS. 2 and 3) for the blade 18, positively securing the blade 18 within the receptacle 38 and thus the handle portion 12. Secondly, the offset parting line 36 provides a larger unbroken surface around the second end 16 of the handle portion 12, which provides advantages as discussed further below. While only the rasp surface 26 has been switched to the second side 22 of the handle 12 in the left hand tool 10 of FIG. 3, it will be seen that the two sections 32 and 34 of the handle portion 12 may be formed as mirror images of one another, (FIGS. 2 and 3) to place the blade receptacle 38 in the smoothly finished second section 34 of the handle portion 12, as in FIGS. 1, 2, and 4.

The smoothly rounded, compound convex curvature 40 of the second end 16 of the tool 10 also serves a function related to the other functions of the tool 10 discussed above. The curvature 40 of the second end 16 will be seen to be around the major dimension or width, W and also around the minor dimension or thickness T of the second end 16 of the handle portion 12. The resulting smoothly rounded, compound convex curvature 40 serves as a tamping or burnishing tool for smoothing the roughened or protruding edges of the cut or torn paper covering of a wallboard sheet after the sheet is cut or broken. As in the case of the rasp function described above, the tool 10 may be worked away from the blade 18 for greater safety, but due to the rounded form of the second end 16, may be worked in either direction as desired to smooth a roughened wallboard edge.

In accordance with the above disclosure, the present combination hand tool 10 will be seen to provide multiple functions and uses in working with wallboard in interior construction work. The handle 12 and utility knife blade 18 provide for cutting or scoring the paper covering of the wallboard, as shown in FIG. 1, whereupon the board may be broken or separated along the cut or scored line. The configuration of the tool 10 of FIGS. 1, 2, and 4, wherein the rasp surface 26 is disposed away from the palm of a right handed user of the tool when the cutting edge of the blade 18 is positioned downward, reduces abrasion or irritation to the right hand of a user of the tool when the tool is used conventionally. The left handed tool of FIG. 3 positions the rasp surface 26 to the opposite or second side 22. Alternatively, a rasp surface 26 may be provided on both sides 20 and 22 of the handle portion 12, if desired.

The resulting relatively rough exposed edge of the gypsum core may then be smoothed by using the rasp surface 26 formed on either the first side 20 for right handed users as shown in FIG. 1 or the second side 22 (for left handed users) of the handle portion 12, as described above and shown in FIG. 3, if the wallboard edge is to be located at an otherwise exposed corner; the smoothed edge will result in less time and materials being required for the finishing of the edge. The orientation of the grooves or teeth 24 of the rasp surface 26 ensure that the user must draw the tool away from the first end 14 with its blade 18 extending therefrom, thereby providing safety in the event the user's hand slips from the handle portion 12, as the hand will move along the handle 12 toward the smoothly rounded second end 16 and away from the blade 18.

A third function of the tool 10 is provided by the smoothly rounded end, useful for depressing the roughened or protruding edges of the paper covering of wallboard after the wallboard is cut and/or broken to the desired shape. By working the smoothly rounded convex curvature 40 of the second end 16 of the tool 10 along the paper edge, the edge will be depressed and smoothed, thereby again reducing the time and materials which would otherwise be required to fill over and smooth the protruding rough edge, and eliminating any requirement for additional tools.

The handle portion 12 of the tool 10 is preferably formed of a durable, corrosion resistant material, e.g., aluminum, but for even greater durability and longevity, particularly for the edges of the rasp teeth 24, the two mating sections 32 and 34 of the handle portion 12 may be formed of steel, or for greater corrosion resistance, formed of stainless steel. The resulting handle portion 12 will outlive numerous blades 18, and provision is made for removal of the blade 18 for sharpening or replacement by means of the screw 42 which secures the two sections 32 and 34 together. The resulting tool 10 will be seen to save the user considerable time in not having to switch to a different tool as a wallboard sheet is prepared, and further to be cost efficient in its reduction in the number of additional tools otherwise needed to prepare a sheet of wallboard or drywall as described above.

It is to be understood that the present invention is not limited to the sole embodiment described above, but encompasses any and all embodiments within the scope of the following claims.

I claim:

1. A combination hand tool with a fixed knife blade and devoid of moving parts for use in the fabrication and finishing of wallboard construction, said tool comprising:

an elongate handle portion having a first end and an opposite second end, with said first end having a planar utility knife blade fixed therein, and said second end having a smoothly rounded compound convex curvature thereto;

said handle portion further having a width and a thickness, with said handle portion width being greater than said handle portion thickness, and having opposite first and second sides extending perpendicularly across said width, with said first and second sides being substantially flat and parallel to said planar utility knife blade, and;

at least one of said first and second sides of said handle portion having a plurality of transverse rasp teeth, said transverse rasp teeth comprising a plurality of sharp edged teeth perpendicularly extending across at least one of said first and second sides of said handle portion, with each tooth of said teeth having a first face angled toward said first end of said handle portion having said knife, and an opposite second face being perpendicular to said first and second sides of said handle portion, wherein cutting and smoothing action of said rasp teeth is provided when said combination tool is drawn along a wallboard edge in a direction toward said second end of said handle portion and away from said planar utility knife blade extending from said first end of said handle portion; and said combination hand tool being devoid of any movable parts, whereby said combination tool further serves as a cutting tool by means of said knife blade, and a tamping and burnishing tool by means of said smoothly rounded, compound convex curvature of said second end of said handle portion.

2. The combination hand tool of claim 1 wherein:

said handle portion comprises a first section and a second section with a parting line therebetween, with said parting line defining a plane parallel to said planar utility knife blade.

3. The combination hand tool of claim 2 wherein:

said planar utility knife blade is centered within said handle portion, and said parting line is offset, and said first section of said handle portion has a thickness less than said second section of said handle portion.

4. The combination hand tool of claim 2 wherein:

said first section and said second section of said handle portion are separable to provide for the replacement of said planar utility knife blade, with said knife blade being immovably affixed within said handle portion when said first section and said second section are assembled together.

5. The combination tool of claim 1 wherein:

at least said handle portion is formed of aluminum.

6. The combination tool of claim 1 wherein:

at least said handle portion is formed of steel.

7. The combination tool of claim 6 wherein:

at least said handle portion is formed of stainless steel.

8. The combination tool of claim 1, wherein:

both of said first and second sides of said handle portion have said plurality of transverse rasp teeth.

* * * * *